US005632391A

United States Patent [19]

Erdmann

[11] Patent Number: 5,632,391

[45] Date of Patent: May 27, 1997

[54] WEIGHT FOR A LIFT-LIMITING SWITCH

[75] Inventor: Gerd Erdmann, Oldenburg, Germany

[73] Assignee: Kidde Industries, Inc., Iselin, N.J.

[21] Appl. No.: 419,027

[22] Filed: Apr. 10, 1995

[30] Foreign Application Priority Data

Apr. 13, 1994 [DE] Germany ..... 44 12 579.9

[51] Int. Cl.[6] ..... B66C 23/90

[52] U.S. Cl. ..... 212/281

[58] Field of Search ..... 212/281, 292; 294/90

[56] References Cited

U.S. PATENT DOCUMENTS

| | | | |
|---|---|---|---|
| 1,073,751 | 9/1913 | Guiberson | 294/90 |
| 1,660,708 | 2/1928 | Grant | 294/90 |
| 2,029,709 | 2/1936 | Field | 212/292 |
| 2,388,219 | 10/1945 | Parker . | |
| 3,969,714 | 7/1976 | Greer | 212/281 |
| 4,535,899 | 8/1985 | Bergeron . | |
| 5,263,660 | 11/1993 | Brozik . | |
| 5,362,029 | 11/1994 | Kallenberger | 212/281 |

FOREIGN PATENT DOCUMENTS

| | | |
|---|---|---|
| 17 56 076 | 6/1970 | Germany . |
| 28 46 394 | 5/1979 | Germany . |
| U-91 15 400 | 4/1982 | Germany . |

*Primary Examiner*—Thomas J. Brahan

[57] ABSTRACT

A weight for operating the lift-limiting switch of a crane, especially a telescoping-boom crane, is composed of two identical castings connected together by a hinge at one side and having a lock on the opposite side which, when actuated, holds the two members around the crane cable but which can be opened to allow the weight to be placed over the cable or to be removed therefrom.

12 Claims, 4 Drawing Sheets

WEIGHT FOR A LIFT-LIMITING SWITCH

FIELD OF THE INVENTION

My present invention relates to a weight for a lift-limiting switch adapted to fit around the cable of a crane and to actuate the switch upon lifting of the load-engaging tackle to prevent impact of the tackle against the crane boom point or head.

BACKGROUND OF THE INVENTION

In a crane, especially a telescoping-boom crane, at the boom point or head, the cable for lifting the load can extend downwardly to terminate at its lower end in a block or other unit of tackle engaging the load. A danger upon operation of such a crane is that the tackle will impact upon the crane head or point.

To prevent such impact, the head of the crane may be provided with a lift-limiting switch which, upon operation, will terminate the lifting operation.

In the telescoping crane system of U.S. Pat. No. 5,213,660, a weight is mounted on the cable and is suspended for a ligature which is connected to the lift-limiting switch at the head of the crane. While the weight applies tension to the ligature, lifting can proceed. When the lower load block, i.e. the load-engaging tackle, is lifted to raise the weight, the tension on the ligature is relaxed to allow the switch to automatically shift into a position which deactivates the winch and terminates the lifting operation.

Weight suspended from a boom in another system is found in U.S. Pat. No. 4,535,899 and reference may also be had, in this connection, to German Patent documents DE-OS 1,756,076 and DE-OS 28 46 394.

The weights for operating the lift-limiting switch may consist of a number of pieces in prior art systems but to apply the weight to the cable or remove the weight from the cable generally the weight must be disassembled, thereby complicating the operation and making the process time-consuming. Furthermore, the fact that the device must be disassembled permits parts to be lost.

OBJECTS OF THE INVENTION

It is, therefore, the principal object of the present invention to provide a weight for the purposes described which does not require disassembly to enable it to be placed around the cable or removed therefrom.

Another object of the invention is to provide an improved weight for operating a lift-limiting switch of a crane, whereby drawbacks of earlier systems are obviated.

SUMMARY OF THE INVENTION

These objects and others which will become apparent hereinafter are attained, in accordance with the invention by providing the weight from two identical shaped bodies or members which are interconnected by a hinge and can be locked together by a locking element. The members can be identical cast bodies which, however, can be machined differently, e.g. one to receive the locking pin and the other to contain the bore or recess in which the locking pin registers.

For opening of the weight to permit its removal from the cable or for mounting it upon the cable, it is merely necessary to release the lock so that the two members can be swung into an open position and then swung closed around the cable. Upon displacement of the members into the latter position, the lock can automatically engage.

Where the hinge is formed by a threaded bolt extending through side formations in the two members, the members can be replaced or interchanged in a simple manner.

The lock is preferably a spring-loaded pin which can be displaceable in a threaded sleeve which is threaded into a side formation in one of the members so that the pin, under spring force can engage in a bore provided in the other member. In this case, the unlocking can be effected by simply pulling upon the pin by hand. The opening of the weight, therefore, does not require the use of any tool.

In a preferred embodiment of the invention, the two members are castings formed of iron which are identical to one another prior to machining and which can be oriented with one member inverted relatively to the other. The side formations of the two members can be formed as teeth which fit together snugly to minimize the gaps between them and each member preferably has three such teeth, two on one side and one on the other, the teeth being offset from the median plane. The two teeth on respective sides of the two members can interengage to form the hinge when a threaded bolt is inserted through them.

The weight for a lift-limiting switch of a crane, especially a boom-type telescoping crane can comprise:

- two substantially identical members of generally U-shaped cross section, each of the members being formed with a channel and having side formations flanking the respective channel;
- means forming a hinge between side formations of the members, thereby enabling the members to be fitted around the cable and to receive the cable with clearance in the channels; and
- lock means on the members selectively operable to retain the members in a closed position enclosing the cable and enabling the members to be swung about the hinge into an open position for enabling the weight to be placed on and removed from the cable.

The invention also includes a crane system which comprises:

- a boom having a boom head;
- a cable depending from the boom head and raisable and lowerable therefrom;
- tackle on the cable for engaging the cable with a load;
- a lift-limiting switch actuatable terminate raising for the tackle;
- a weight surrounding the cable and actuating the switch upon upward entrainment of the weight by the tackle, the weight comprising:
  - two substantially identical members of generally U-shaped cross section, each of the members being formed with a channel and having side formations flanking the respective channel,
  - means forming a hinge between side formations of the members, thereby enabling the members to be fitted around the cable and to receive the cable with clearance in the channels, and
  - lock means on the members selectively operable to retain the members in a closed position enclosing the cable and enabling the members to be swung about the hinge into an open position for enabling the weight to be placed on and removed from the cable; and
- a flexible member anchored to the weight and to the head for suspending the weight from the head.

BRIEF DESCRIPTION OF THE DRAWING

The above and other objects, features, and advantages will become more readily apparent from the following description, reference being made to the accompanying drawing in which.

SPECIFIC DESCRIPTION

Figure 8:
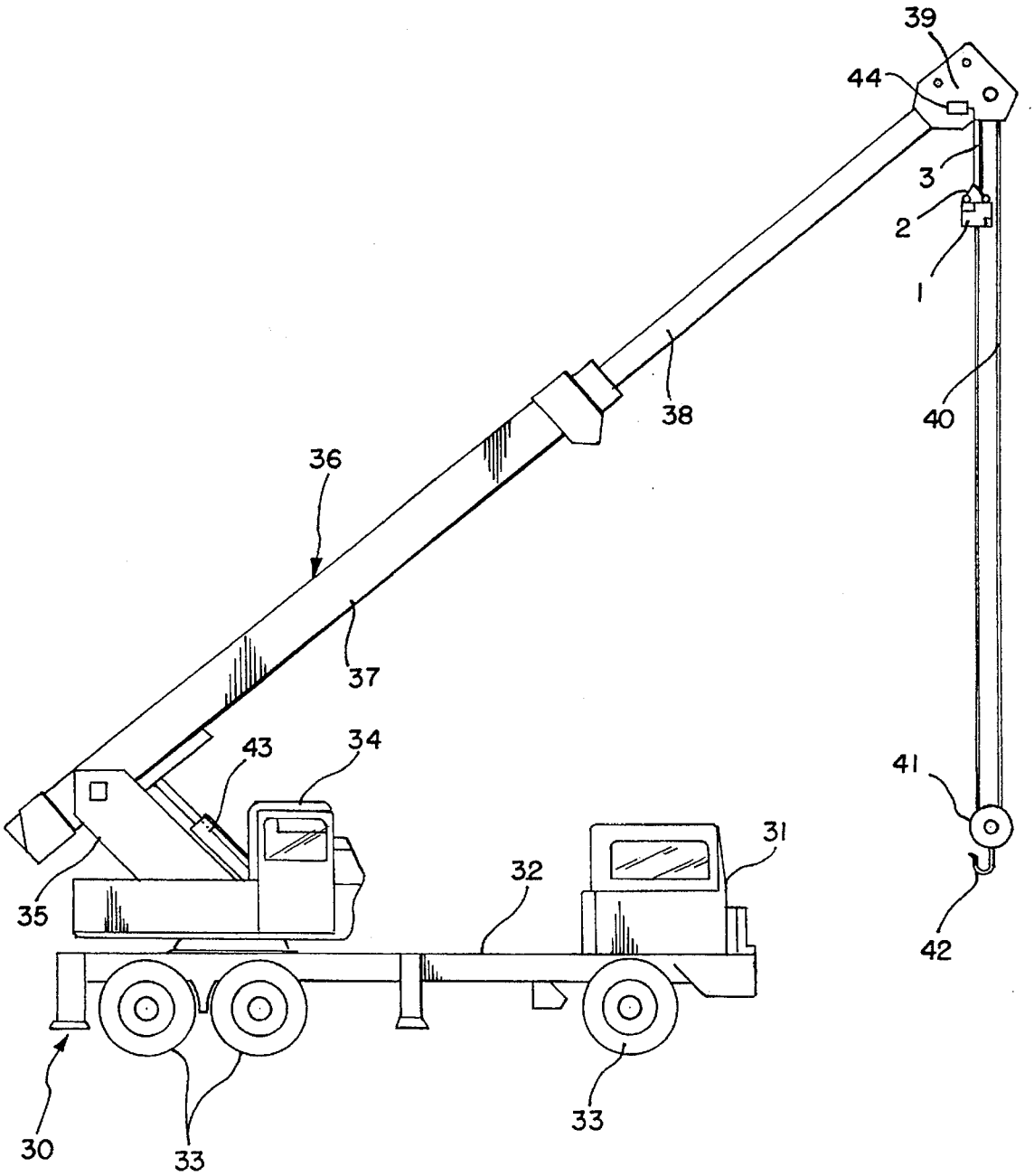
FIG. 8 is an elevational view of a crane provided with the system of FIG. 1.

Turning first to FIG. 8, it can be seen that a telescoping boom crane can comprise a vehicle 30 having a chassis 32 provided with a driver's cab 31 and wheels 33 driven from its cab which can allow the crane to travel from place to place. The crane also has a turntable 34 which is provided with a support 35 for a boom 36 which can be raised and lowered by, for example, the hydraulic cylinder 43, the boom 36 being shown in an elevated position in FIG. 8. The boom 36 is of the telescoping type and can include an inner member 38 displaceable from the member 37 upon extension of the boom. At the boom point, a head 39 is provided which can form one block of a two-block tackle, the lower block 41 of which has a hook 42 for a load to be raised and lowered by the crane. The cable is represented at 41 and, as is also apparent from FIG. 8, the head 39 can be provided with a switch 44 limiting the lifting movement when the lower block 41 engages a weight 1 surrounding the cable 40 and suspended from the head by a ligature or flexible element 3. The weight itself can operate the switch or the switch can be operated by relief of the tension of the ligature when the weight 1 is lifted by the lower portion of the tackle.

The weight has been shown in greater detail in FIGS. 1–7.

Figure 1:
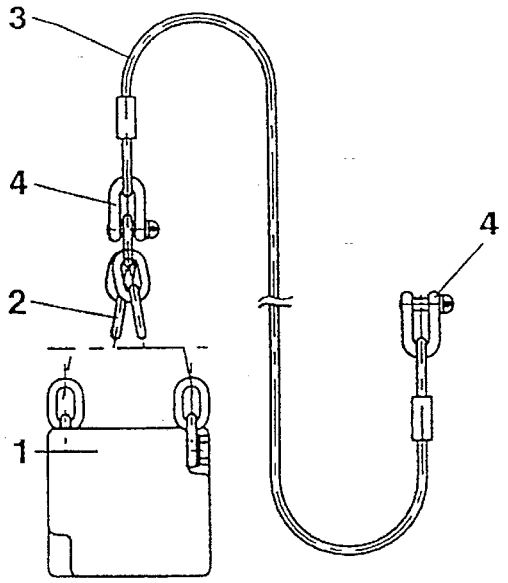
FIG. 1 is a diagrammatic elevational view of a weight with its ligature or suspending element according to the invention.

In FIG. 1, for example, I have shown the weight 1 to be connected via chains 2 with the ligature or flexible member via a shackle 4 or a similar element, an additional shackle 4 being provided at the free end of the ligature 3 for connection of the head of the crane so that the weight 1 can be suspended along the cable.

Figure 2:
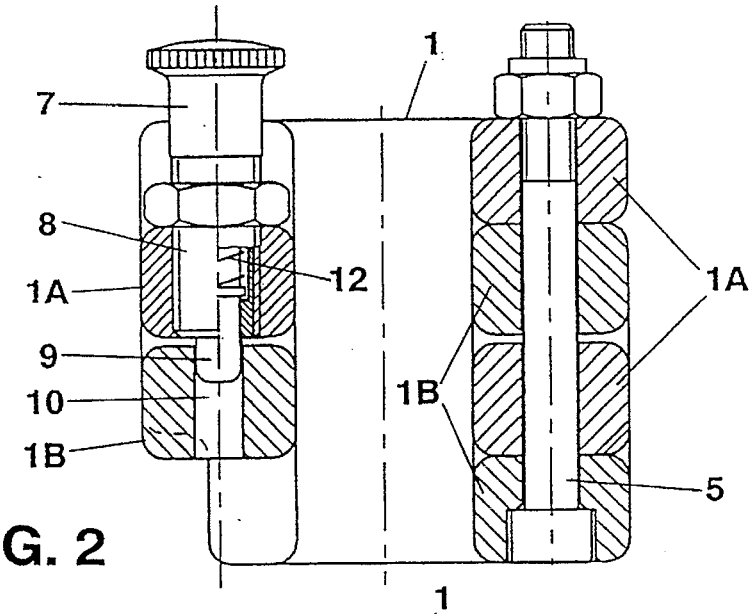
FIG. 2 is a section through the weight formed from two generally identical castings and showing the locking pin in place, FIG. 2 being a section along the line II—II of FIG. 3.
Figure 3:
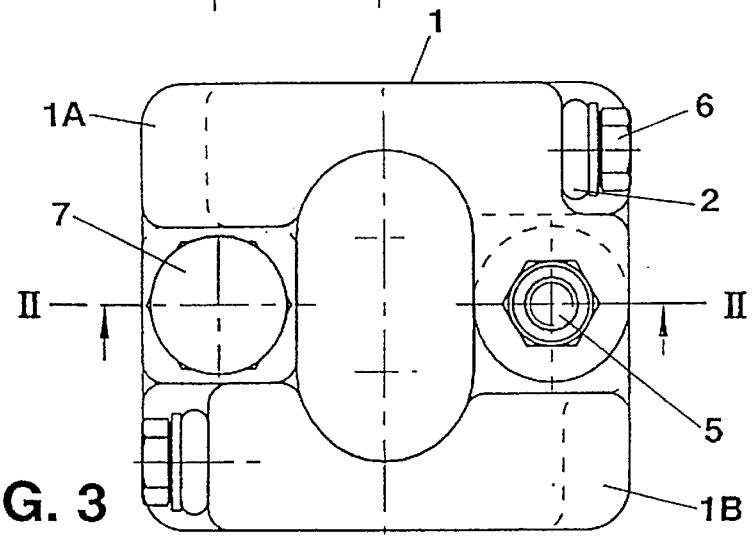
FIG. 3 is a plan view of the weight of FIG. 2.

As can be seen from FIGS. 2 and 3, the weight 1 is composed of two identical cast bodies 1A and 1B, the body 1B being inverted relative to the member 1A. The two members are connected by a threaded bolt 5 forming a hinge. Each of the members 1A and 1B is provided with a screw 6 threaded through one of the links of the chain 2.

To lock the two members 1A and 1B together, a spring-loaded pin 7 is provided which has an end 9 engageable in a bore 10 provided in the member 1B. The spring biasing the pin downwardly (FIG. 2) has been represented at 12 and bears upon the shoulder 45. Surrounding the pin 7 is a threaded sleeve 8 with a head 46 of hexagonal shape enabling it to be engaged by a wrench so that the sleeve 8 can be threaded into a bore 47 in member 1A. The handle 48 of the pin enables it to be gripped by the fingers and pulled out of the bore 10.

Figure 4:
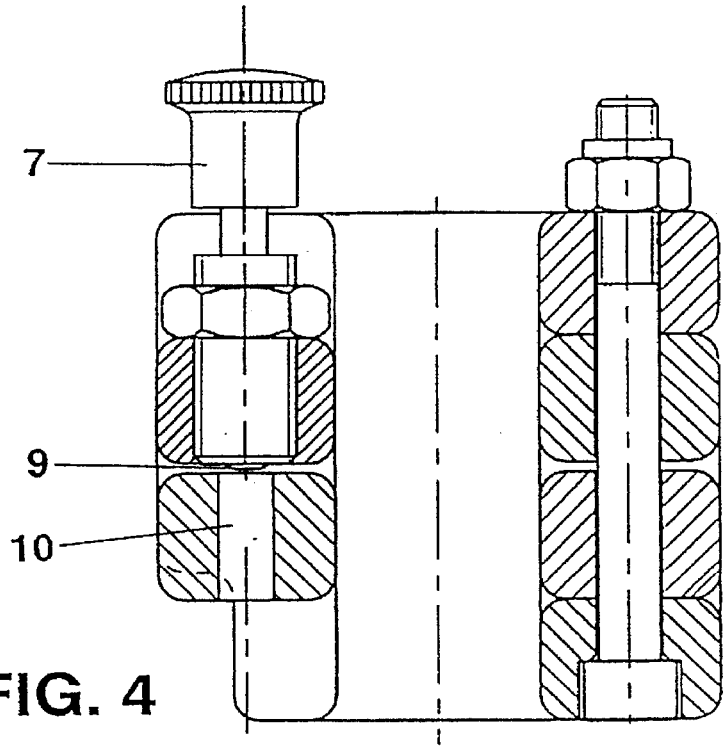
FIG. 4 is a section similar to FIG. 2 but showing the locking pin withdrawn from the bore to permit opening of the weight.
Figure 5:
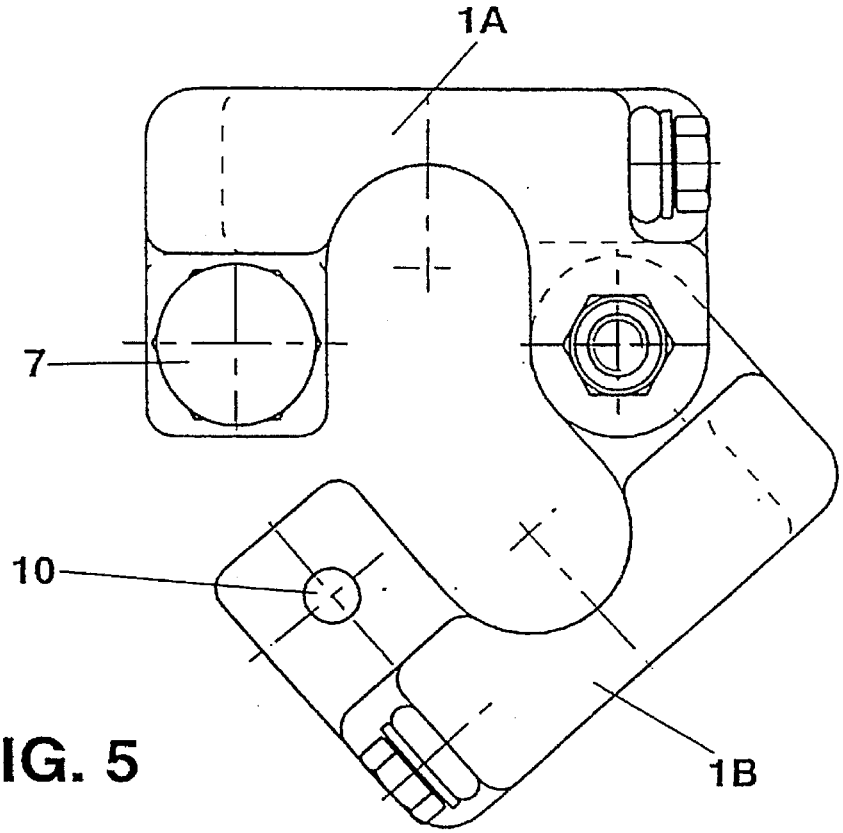
FIG. 5 is a plan view similar to FIG. 4 illustrating the open weight.

In FIGS. 4 and 5, for example, I have shown the pin 7, 9 retracted from the bore 10 so that the two members 1A and 1B can be swung apart, (FIG. 5) to enable them to be fitted around the cable 40 which then passes with clearance through the passage formed in the weight when the two members are again swung into the closed position and the pins 7, 9 drop automatically into the bore 10.

Figure 6:
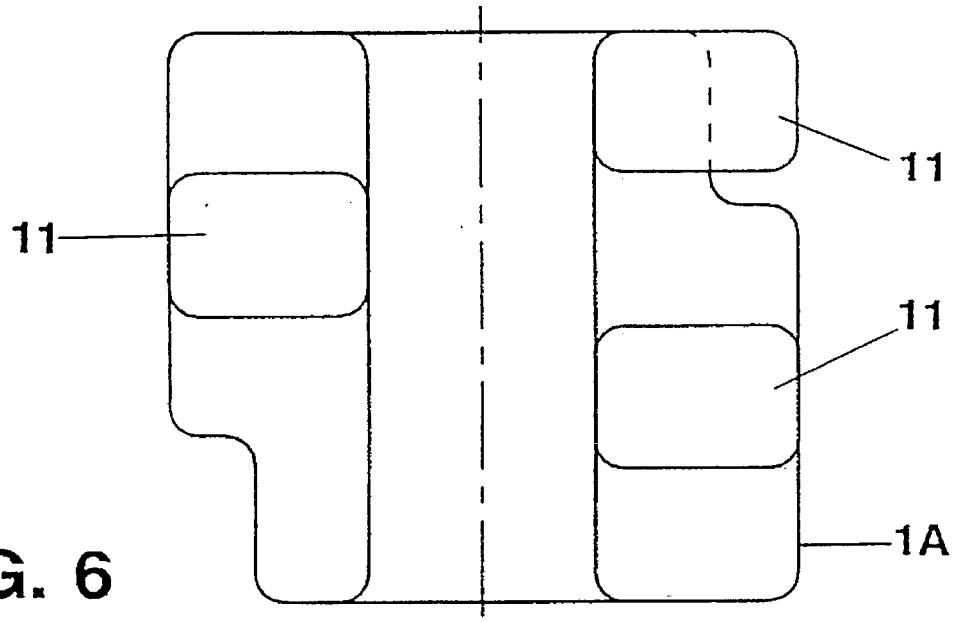
FIG. 6 is a front view of one of the two identical members forming the weight of the invention.
Figure 7:
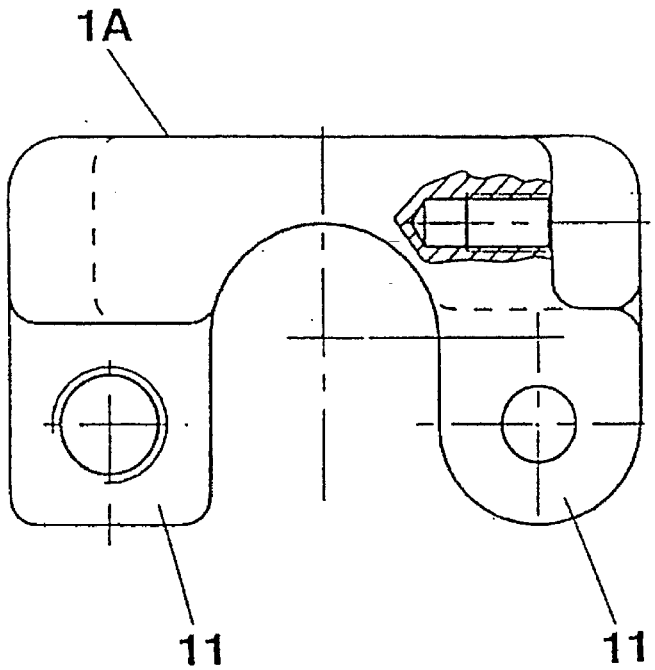
FIG. 7 is a plan view of the member of FIG. 6.

FIGS. 6 and 7 show the member 1A in greater detail, member 1B being identical thereto. As will be apparent from FIGS. 6 and 7, the members 1A and 1B have troughs 49 which are flanked by side formations or teeth. Two such formations are provided at 11 on one side of the trough and interdigitate with the two formations on the corresponding side of member 1B which is inverted relative to member 1A (FIG. 2).

On the opposite side is another tooth forming the corresponding side member 11. In the case of member 1A, the casting is threaded to receive the sleeve 8 whereas in the case of member 1B, that side formation is drilled to provide the bore 10.

The members 1A and 1B may be recessed at 50 to accommodate the bolts 6 and the chain links.

I claim:

1. A weight for a lift-limiting switch of a crane having a cable adapted to lift a load, said weight comprising:

two identically cast members of generally U-shaped cross section, each of said members being formed with a channel and having side formations flanking the respective channel;

means forming a hinge between side formations of said members, thereby enabling said members to be fitted around said cable and to receive said cable with clearance in said channels; and lock means on said members selectively operable to retain said members in a closed position enclosing said cable and enabling said members to be swung about said hinge into an open position for enabling said weight to be placed on and removed from said cable.

2. The weight defined in claim 1 wherein said hinge is formed by a threaded bolt traversing bores in interdigitating blocks constituting the side formations on one side of each of said members.

3. The weight defined in claim 1 wherein said lock means comprises a locking pin mounted in a side formation of one of said members engageable in a recess of a corresponding side formation of the other of said members.

4. The weight defined in claim 3 wherein said locking pin is spring loaded in a threaded sleeve threaded into said one of said members and automatically entering a bore formed in the other member upon registry of said bore with said pin.

5. The weight defined in claim 1 wherein said side formations of said members are interfittable teeth.

6. The weight defined in claim 4 wherein each of said members has a pair of said side formations on one side of the respective channels and a single one of said side formations on an opposite side of the respective channels and the side formations are offset with respect to a horizontal median plane through said weight.

7. A telescoping crane, comprising:

a boom having a boom head;

a cable depending from said boom head and raisable and lowerable therefrom;

tackle on said cable for engaging said cable with a load;

a lift-limiting switch actuatable to terminate raising of said tackle;

a weight surrounding said cable, said weight including, two identically cast members of generally U-shaped cross section, each of said members being formed with a channel and having side formations flanking the respective channel, means forming a hinge between side formations of said members, thereby enabling said members to be fitted around said cable and to receive said cable with clearance in said channels, and lock means on said members selectively operable to retain said members in a closed position enclosing said cable and enabling said members to be swung about said hinge into an open position for enabling said weight to be placed on and removed from said cable; and a flexible member anchored to said weight and to said head for suspending said weight from said head such that upon upward contact between said weight and said switch caused by said tackle, said weight actuates said switch.

8. The crane defined in claim 7 wherein said hinge is formed by a threaded bolt traversing bores in interdigitating blocks constituting the side formations on one side of each of said members.

9. The crane defined in claim 8 wherein said lock means comprises a locking pin mounted in a side formation of one of said members engageable in a recess of a corresponding side formation of the other of said members.

10. The crane defined in claim 9 wherein said locking pin is spring loaded in a threaded sleeve threaded into said one of said members and automatically entering a bore formed in the other member upon registry of said bore with said pin.

11. The weight defined in claim 10 wherein said side formations of said members are interfittable teeth.

12. The weight defined in claim 11 wherein each of said members has a pair of said side formations on one side of the respective channels and a single one of said side formations on an opposite side of the respective channels and the side formations are offset with respect to a horizontal median plane through said weight.

* * * * *